US007686638B2

(12) United States Patent
Boyd et al.

(10) Patent No.: US 7,686,638 B2
(45) Date of Patent: Mar. 30, 2010

(54) METHOD AND APPARATUS FOR COUPLING A CABLE TO A SOCKET

(75) Inventors: Scott J. Boyd, Pflugerville, TX (US); John Morrison, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 12/168,152

(22) Filed: Jul. 6, 2008

(65) Prior Publication Data

US 2008/0268696 A1 Oct. 30, 2008

Related U.S. Application Data

(62) Division of application No. 11/438,206, filed on May 22, 2006, now abandoned.

(51) Int. Cl.
*H01R 4/50* (2006.01)

(52) U.S. Cl. ..... 439/344; 439/352; 439/353; 439/923

(58) Field of Classification Search ..... 439/353, 439/344, 357, 923, 352, 354, 676
See application file for complete search history.

(56) References Cited

U.S. PATENT DOCUMENTS 3,761,869 A * 9/1973 Hardesty et al. ..... 439/418
4,074,928 A * 2/1978 Johnston ..... 439/304
5,090,916 A 2/1992 Magnier
5,562,475 A 10/1996 Kern et al.
5,993,236 A * 11/1999 Vanderhoof et al. ..... 439/344
6,547,598 B1 4/2003 Chen
6,592,397 B2 7/2003 Pocrass
6,835,086 B1 * 12/2004 Tsai ..... 439/354
6,920,287 B1 7/2005 Hinds et al.
6,921,283 B2 7/2005 Zahlit et al.
7,025,636 B2 * 4/2006 Allen ..... 439/638
7,029,311 B2 4/2006 Peloza
7,297,013 B2 * 11/2007 Caveney et al. ..... 439/352
7,361,047 B2 * 4/2008 Strahl ..... 439/354
7,540,756 B1 * 6/2009 Strahl ..... 439/354
2004/0224539 A1 11/2004 Boyd et al.
2006/0035480 A1 2/2006 Boyd et al.
2006/0223380 A1 10/2006 King et al.

* cited by examiner

*Primary Examiner*—Xuong M Chung-Trans
(74) *Attorney, Agent, or Firm*—Haynes and Boone, LLP

(57) ABSTRACT

A cable coupling apparatus includes a base defining a connector channel. A connector coupling feature is located on the base and operable to couple a connector positioned in the connector channel to the base. A socket coupling member is resiliently coupled to and extends from the base. A securing member is located on the socket coupling member, wherein the securing member comprises a socket coupling member release surface that is oriented relative to a connector removal direction at an angle of greater than 90 degrees such that the socket coupling member may be deflected by the movement of the base in the connector removal direction and the resulting engagement of a socket surface and the socket coupling member release surface on the securing member in order to remove a connector coupled to the base from a socket. The apparatus may be coupled to a connector or may be fabricated as part of a connector and allows the connector to be removed from the socket by moving the connector in a connector removal direction and without a need to manually disengage the socket surface and the socket coupling member release surface.

12 Claims, 15 Drawing Sheets

METHOD AND APPARATUS FOR COUPLING A CABLE TO A SOCKET

CROSS-REFERENCE TO RELATED APPLICATION

This application claims priority to and is a divisional of co-pending U.S. patent application Ser. No. 11/438,206 filed May 22, 2006, which is incorporated herein by reference in its entirety.

BACKGROUND

The present disclosure relates generally to information handling systems, and more particularly to coupling a cable to a socket on an information handling system.

As the value and use of information continues to increase, individuals and businesses seek additional ways to process and store information. One option is an information handling system (IHS). An IHS generally processes, compiles, stores, and/or communicates information or data for business, personal, or other purposes. Because technology and information handling needs and requirements may vary between different applications, IHSs may also vary regarding what information is handled, how the information is handled, how much information is processed, stored, or communicated, and how quickly and efficiently the information may be processed, stored, or communicated. The variations in IHSs allow for IHSs to be general or configured for a specific user or specific use such as financial transaction processing, airline reservations, enterprise data storage, or global communications. In addition, IHSs may include a variety of hardware and software components that may be configured to process, store, and communicate information and may include one or more computer systems, data storage systems, and networking systems.

IHSs typically include a chassis having a plurality of sockets for accepting connectors that are coupled to cables in order to couple the cables to the IHS. For example, the IHS chassis will typically includes a socket which is operable to accept a Registered Jack-45 (RJ-45) connector that is coupled to a Category 5 (CAT5) cable in order to couple the IHS to a Local Area Network (LAN) such as, for example, an Ethernet. The coupling of these connectors to the sockets raises a number of issues.

The connectors typically include a release member that is resiliently coupled to a connector base. A securing surface is included on the release member. With the connector engaging the socket, the securing surface engages a socket wall in order to secure the connector in the socket. The release member must then be manually deflected from a rest position in order to disengage the securing surface from the socket wall in order to remove the connector from the socket. If the cable is pulled without manually deflecting the release member from the rest position, the connector will not disengage from the socket until the release member breaks, resulting in a connector which may no longer be secured in the socket.

Conventional solutions to solve this problem include replacing the release member with a magnetic connection. In that situation, the connector and the chassis each include magnets, and the force from the magnetic attraction between the magnets secures the connector in the socket. When the cable is pulled with sufficient force, the force from the magnetic attraction between the magnets may be overcome and the connector disengaged from the socket. However, this solution increases costs and is limited by the stacking tolerances between the motherboard based socket, which the connector engages, and the chassis back panel, which the magnet engages.

Accordingly, it would be desirable to provide for coupling a cable to a socket absent the disadvantages found in the prior methods discussed above.

SUMMARY

According to one embodiment, a cable coupling apparatus includes a base defining a connector channel, a connector coupling feature located on the base and operable to couple a connector positioned in the connector channel to the base, a socket coupling member resiliently coupled to and extending from the base, and a securing member located on the socket coupling member, wherein the securing member comprises a socket coupling member release surface that is oriented relative to a connector removal direction at an angle of greater than 90 degrees such that the socket coupling member may be deflected by the movement of the base in the connector removal direction and the resulting engagement of a socket surface and the socket coupling member release surface on the securing member in order to remove a connector coupled to the base from a socket.

DETAILED DESCRIPTION

For purposes of this disclosure, an IHS may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an IHS may be a personal computer, a PDA, a consumer electronic device, a network server or storage device, a switch router or other network communication device, or any other suitable device and may vary in size, shape, performance, functionality, and price. The IHS may include memory, one or more processing resources such as a central processing unit (CPU) or hardware or software control logic. Additional components of the IHS may include one or more storage devices, one or more communications ports for communicating with external devices as well as various input and output (I/O) devices, such as a keyboard, a mouse, and a video display. The IHS may also include one or more buses operable to transmit communications between the various hardware components.

Figure 1:
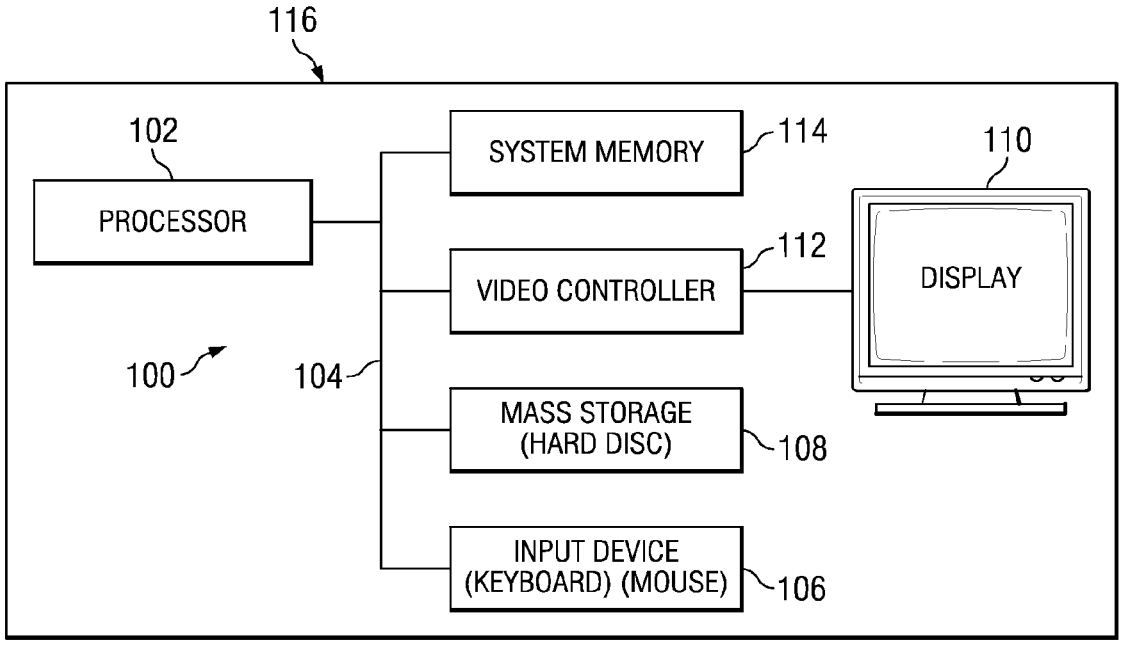
FIG. 1 is a schematic view illustrating an embodiment of an IHS.

In one embodiment, IHS 100, FIG. 1, includes a processor 102, which is connected to a bus 104. Bus 104 serves as a connection between processor 102 and other components of computer system 100. An input device 106 is coupled to processor 102 to provide input to processor 102. Examples of input devices include keyboards, touchscreens, and pointing devices such as mouses, trackballs and trackpads. Programs and data are stored on a mass storage device 108, which is coupled to processor 102. Mass storage devices include such devices as hard disks, optical disks, magneto-optical drives, floppy drives and the like. IHS 100 further includes a display 110, which is coupled to processor 102 by a video controller 112. A system memory 114 is coupled to processor 102 to provide the processor with fast storage to facilitate execution of computer programs by processor 102. In an embodiment, a chassis 116 houses some or all of the components of IHS 100. It should be understood that other buses and intermediate circuits can be deployed between the components described above and processor 102 to facilitate interconnection between the components and the processor 102.

Figure 2A:
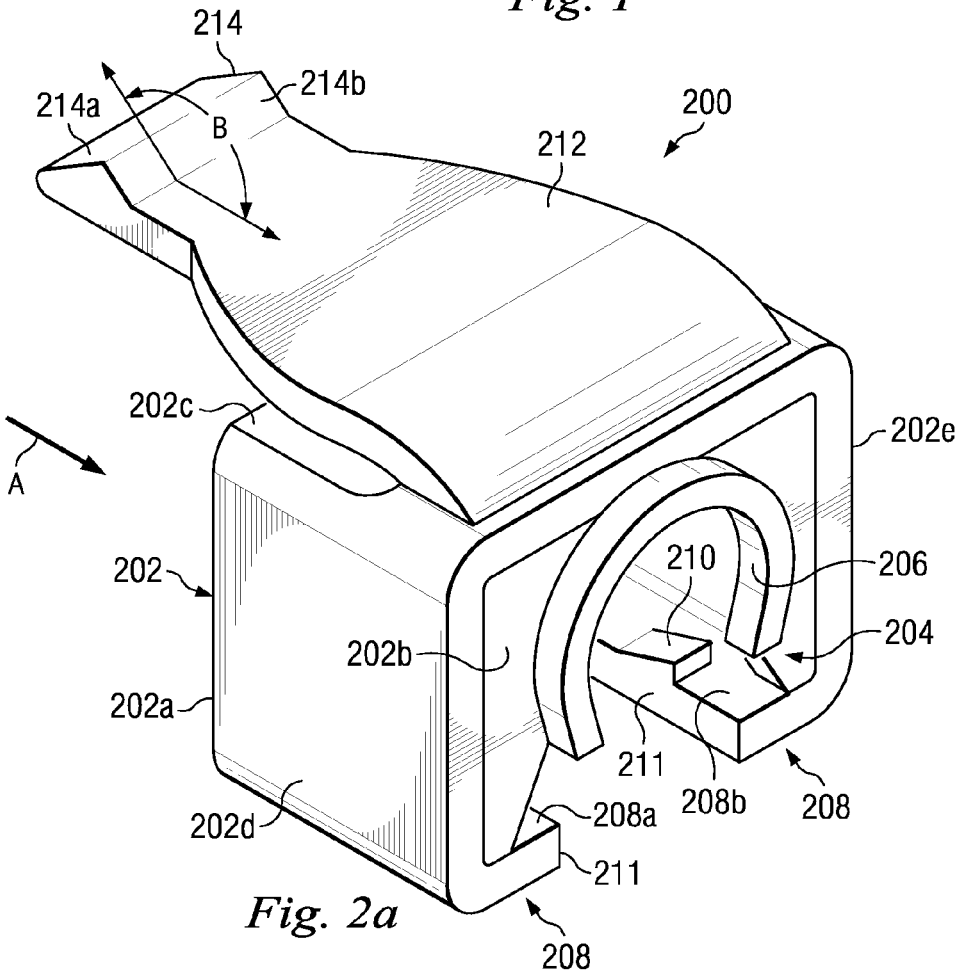
FIG. 2*a* is a perspective view illustrating an embodiment of a cable coupling apparatus.
Figure 2B:
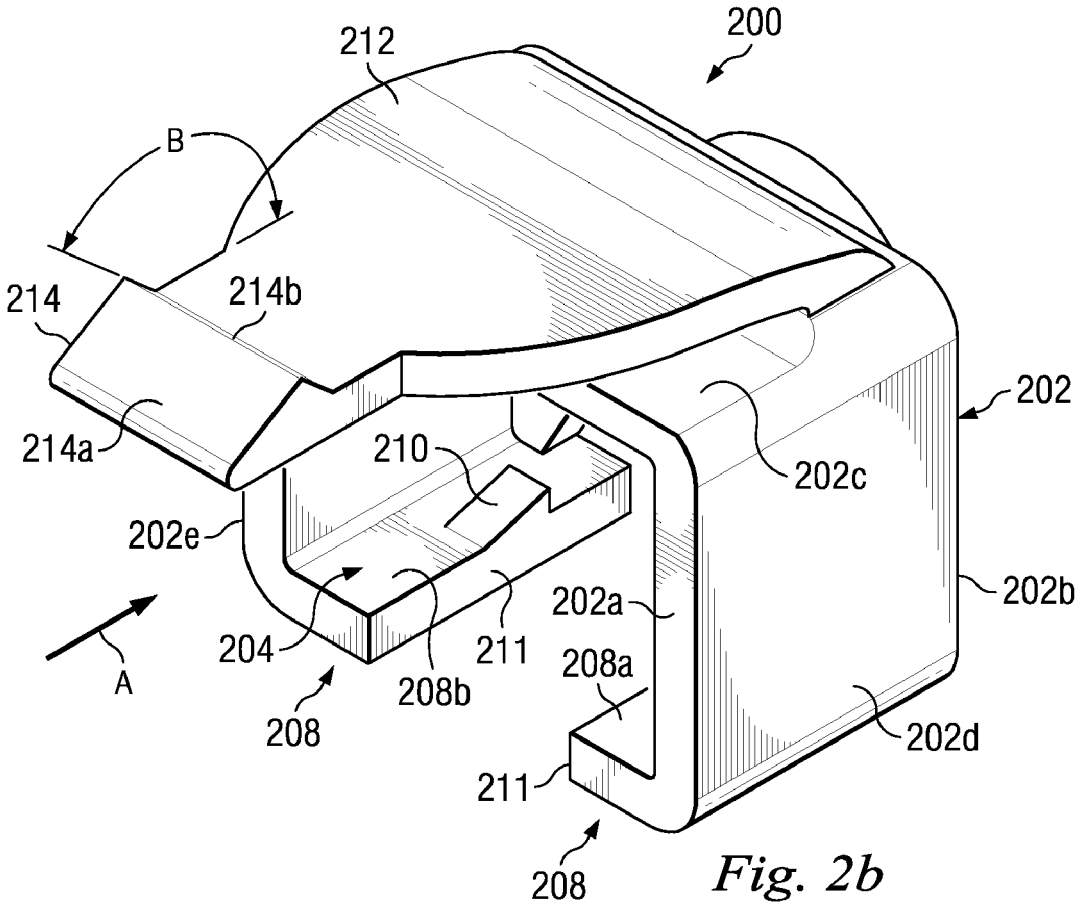
FIG. 2*b* is a perspective view illustrating an embodiment of the cable coupling apparatus of FIG. 2*a*.

Referring now to FIGS. 2*a* and 2*b*, a cable coupling apparatus 200 is illustrated. The cable coupling apparatus 200 includes a base 202 having a front surface 202*a*, a rear wall 202*b* located opposite the front surface 202*a*, a top wall 202*c* extending between the front surface 202*a* and the rear wall 202*b*, and a pair of opposing side walls 202*d* and 202*e* extending between the front surface 202*a*, the rear wall 202*b*, and the top wall 202*c*. The base 202 includes a connector removal direction A which is substantially parallel to the top wall 202*c* and the side walls 202*d* and 202*e*, substantially perpendicular to the rear wall 202*b* and the front surface 202*a*, and will be explained in further detail below. The base 202 also includes a connector channel 204 defined by the base 202 and located between the rear wall 202*b*, the top wall 202*c*, and the pair of side walls 202*d* and 202*e*. A semi-circular cable channel 206 is defined by the rear wall 204, located adjacent the connector channel 204, and provides access to the connector channel 204 through the rear wall 202*b*. A connector coupling feature 208 includes a first bottom wall 208*a* extending substantially perpendicularly from the side wall 202*d* and a second bottom wall 208*b* extending substantially perpendicularly from the side wall 202*e*, each bottom wall 208*a* and 208*b* including a connector securing feature 210 extending from its surface. An entrance 211 is defined by the bottom walls 208*a* and 208*b*, is located between the bottom walls 208*a* and 208*b*, and provides access to the connector channel 204. A socket coupling member 212 is resiliently coupled to and extends from the top wall 202*c* of the base 202 and includes a securing member 214 located on the distal end of the socket coupling member 212. The securing member 214 includes a beveled socket coupling member attachment surface 214*a* located immediately adjacent the distal end of the socket coupling member 212. A socket coupling member release surface 214*b* is located adjacent the beveled socket coupling member attachment surface 214*a* and is oriented relative to the connector removal direction A at an angle B that is greater than 90 degrees and less than 180 degrees. In an embodiment, the angle B is approximately 135 degrees.

Figure 3:
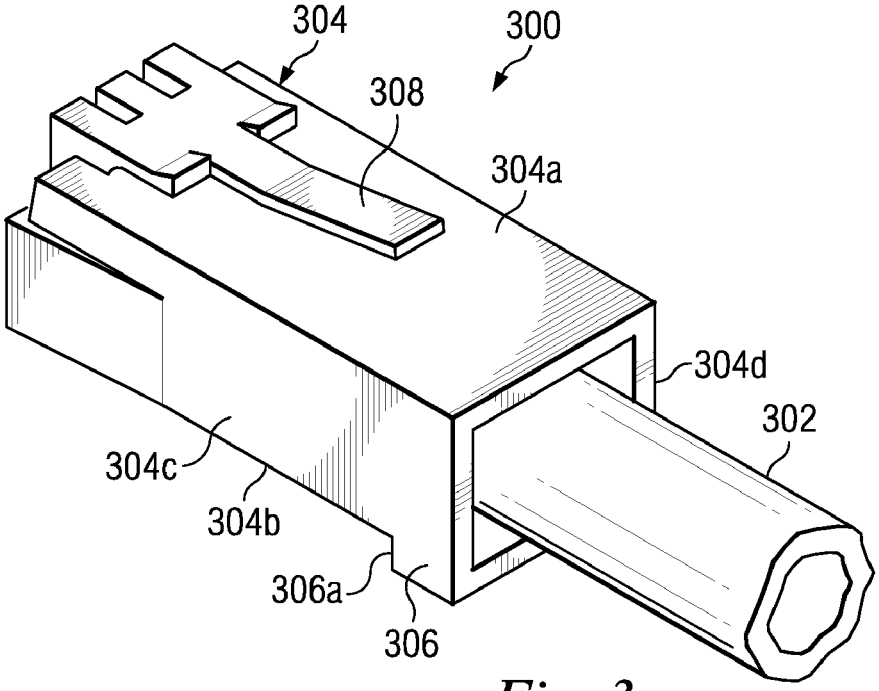
FIG. 3 is a perspective view illustrating an embodiment of a cable used with the cable coupling apparatus of FIGS. 2*a* and 2*b*.

Referring now to FIG. 3, a cable 300 is illustrated. The cable 300 includes an elongated base cable 302 including a connector 304 coupled to its distal end. In an embodiment, the elongated base cable 302 may be, for example, a CAT5 cable, and the connector 304 may be, for example, a RJ-45 connector. However, the disclosure is not limited to such cables and connectors and is meant to apply to any cable/connector combination that is operable to couple to a socket. The connector 304 includes a top surface 304*a*, a bottom surface 304*b* located opposite the top surface 304*a*, and the plurality of side surface 304*c* and 304*d* extending between the top surface 304*a* and the bottom surface 304*b*. A securing member 306 including a securing surface 306*a* extends from the bottom surface 304*b* of the connector 304. A connector manual release member 308 is resiliently coupled to and extends from the top surface 304*a* of the connector 304. A plurality of electrical couplers (not shown) are located on the bottom surface 304*b* of the connector 304 and coupled to wiring (not shown) located in the elongated base cable 302.

Figure 4A:
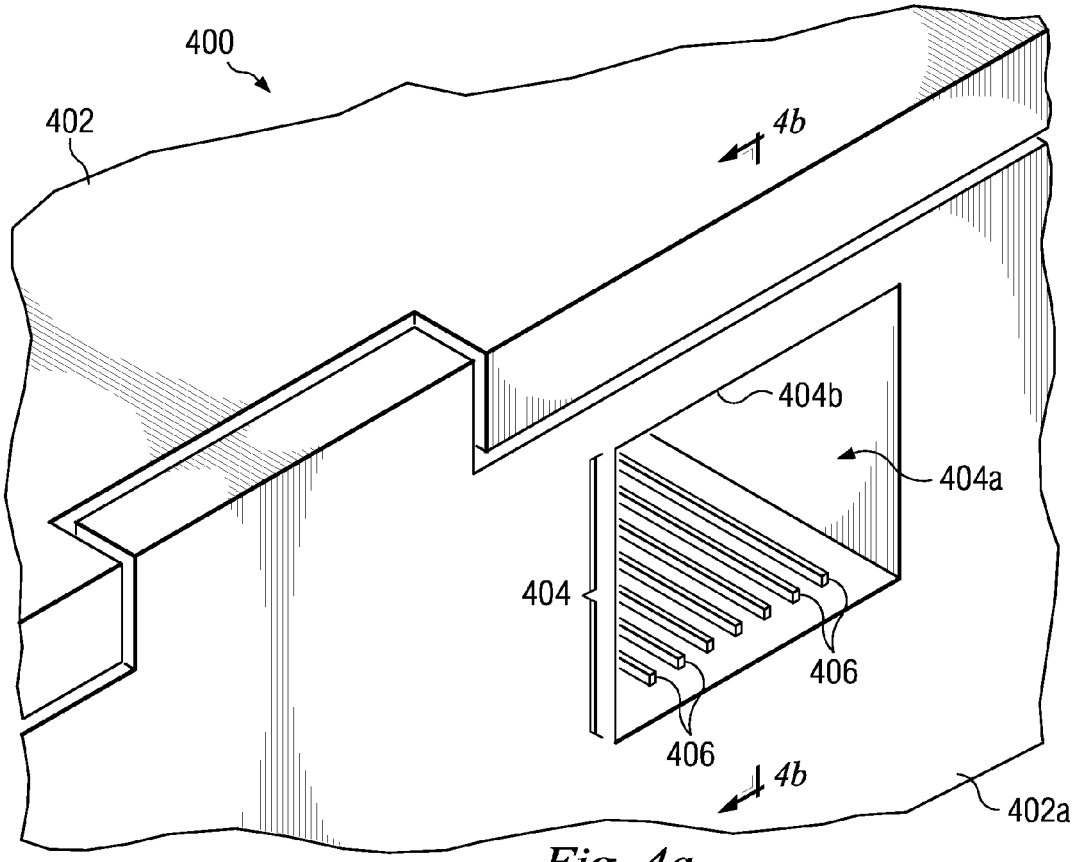
FIG. 4*a* is a perspective view illustrating an embodiment of an IHS used with the cable coupling apparatus of FIGS. 2*a* and 2*b* and the cable of FIG. 3.
Figure 4B:
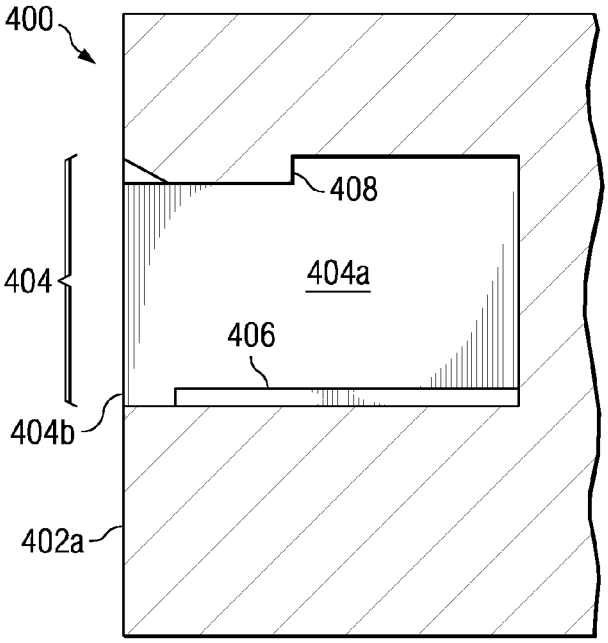
FIG. 4*b* is a cross sectional view illustrating an embodiment of the IHS of FIG. 4*a*.

Referring now to FIGS. 4*a* and 4*b*, an IHS chassis 400 is illustrated. The IHS chassis 400 may be, for example, the chassis 116, described above with reference to FIG. 1, and may house some or all of the components of the IHS 100, described above with reference to FIG. 1. The IHS 400 includes a base 402 having base surface 402*a* and including a socket 404 located in the base 402. The socket 404 defines a connector housing 404*a* and a socket entrance 404*b* located adjacent the base surface 402*a* and providing access to the connector housing 404*a*. A plurality of electrical couplers 406 are located on the socket 404 adjacent the connector housing 404*a* and may be electrically coupled to a processor (not shown) which may be, for example, the processor 102, described above with reference to FIG. 1. The socket 404 includes a socket surface 408 that is located adjacent the connector housing 404*a*. In an embodiment, the socket surface 408 is oriented substantially perpendicularly to the connector removal direction A, described above with reference to FIGS. 2*a* and 2*b* and in further detail below. While the details have been omitted for clarity, the socket 404 may be coupled to a board that is located in the IHS chassis 400 such that the socket 404 is separate from the base 402 and the base surface 402*a*, resulting in a separation between the socket 404 and the base surface 402*a* due to stacking tolerances between the board and the base surface 402*a*.

Figure 5A:
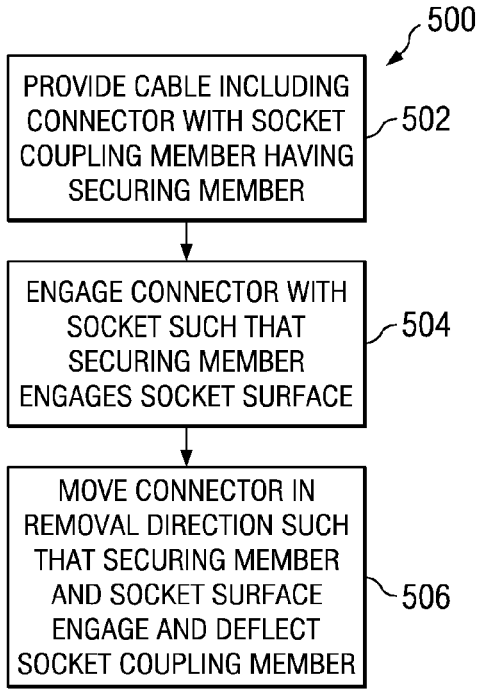
FIG. 5*a* is a flow chart illustrating an embodiment of a method for coupling a cable to a socket.
Figure 5B:
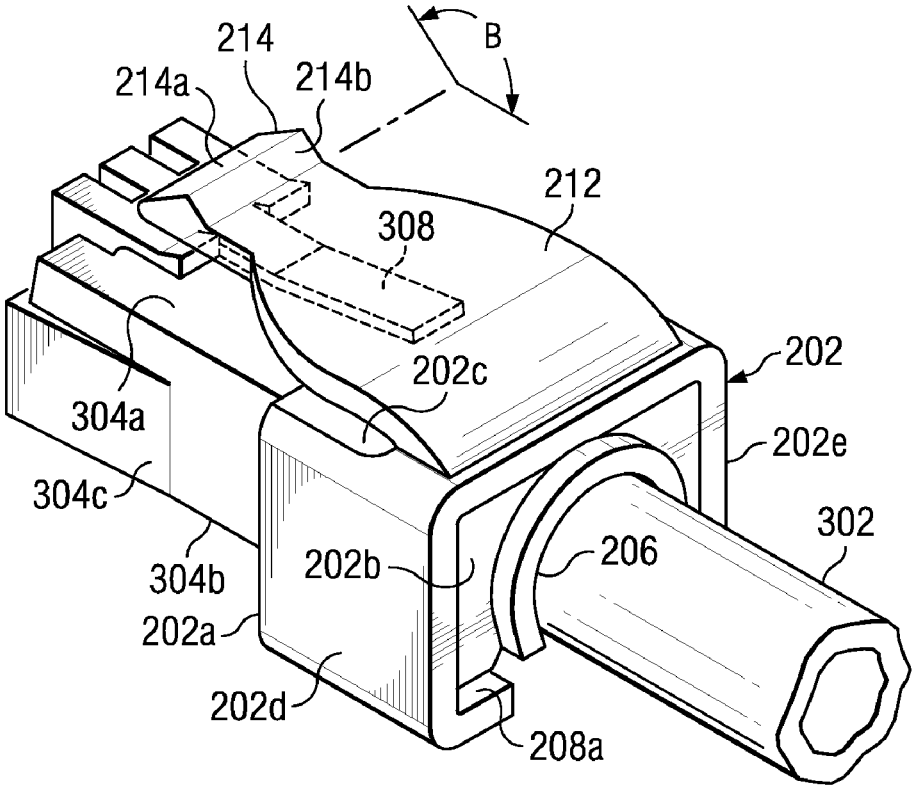
FIG. 5*b* is a perspective view illustrating an embodiment of the cable coupling apparatus of FIGS. 2*a* and 2*b* coupled to the cable of FIG. 3.
Figure 5C:
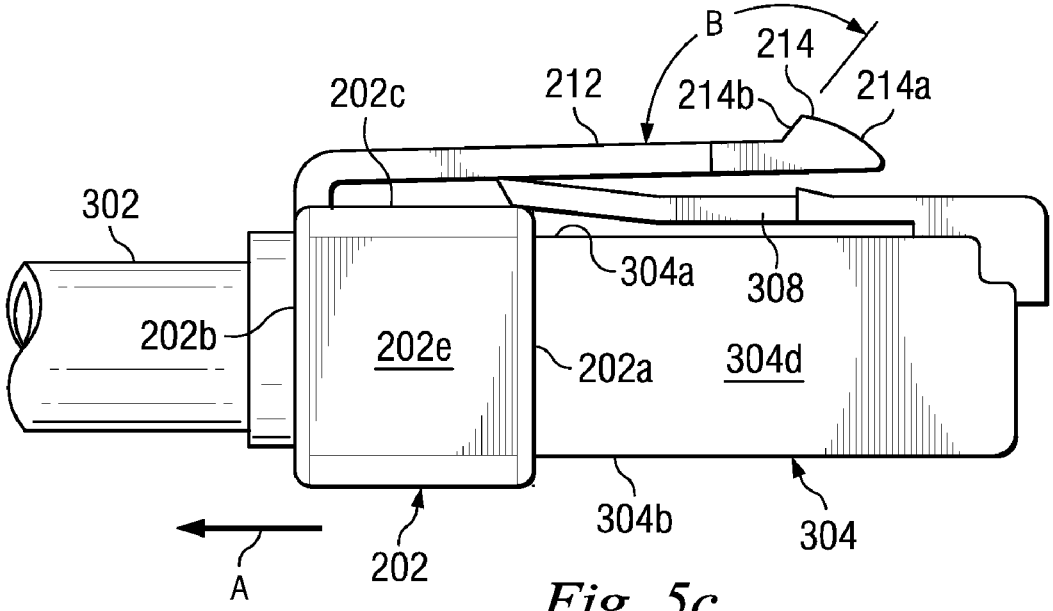
FIG. 5*c* is a side view illustrating an embodiment of the cable coupling apparatus and the cable of FIG. 5*b*.

Referring now to FIGS. 2*a*, 2*b*, 3, 5*a*, 5*b* and 5*c*, a method 500 for coupling a cable to a socket is illustrated. The method 500 begins at step 502 where a cable including a connector with a socket coupling member having a securing member is provided. The cable 300, illustrated in FIG. 3, is provided. The cable coupling apparatus 200 is then positioned adjacent the cable 300 such that the elongated base cable 302 is located immediately adjacent the entrance 211 defined by the bottom walls 208 and 208*b* on the base 202. The elongated base cable 302 is then moved through the entrance 211 such that a portion of the elongated base cable 302 is located in the connector channel 204 and a portion of the elongated base cable 302 is located in the cable channel 206. The cable coupling apparatus 200 is then moved towards the connector 304 on the cable 300 such that the connector 304 is located in the connector channel 204 and the elongated base cable 302 is located in the cable channel 206, as illustrated in FIGS. 5*b* and 5*c*. With the connector 304 positioned in the connector channel 204, the connector 304 may be coupled to the cable coupling apparatus 200 by the engagement of the bottom walls 208*a* and 208*b* with the bottom surface 304*b* of the connector, the engagement of the connector securing features 210 and features (not shown) on the connector 304, and/or a variety of other coupling features known in the art. Furthermore, with the connector 304 secured to the cable coupling feature 200, the connector manual release member 308 is deflected such that it is located between the socket coupling member 212 and the top surface 304*a* of the connector 304.

Figure 5D:
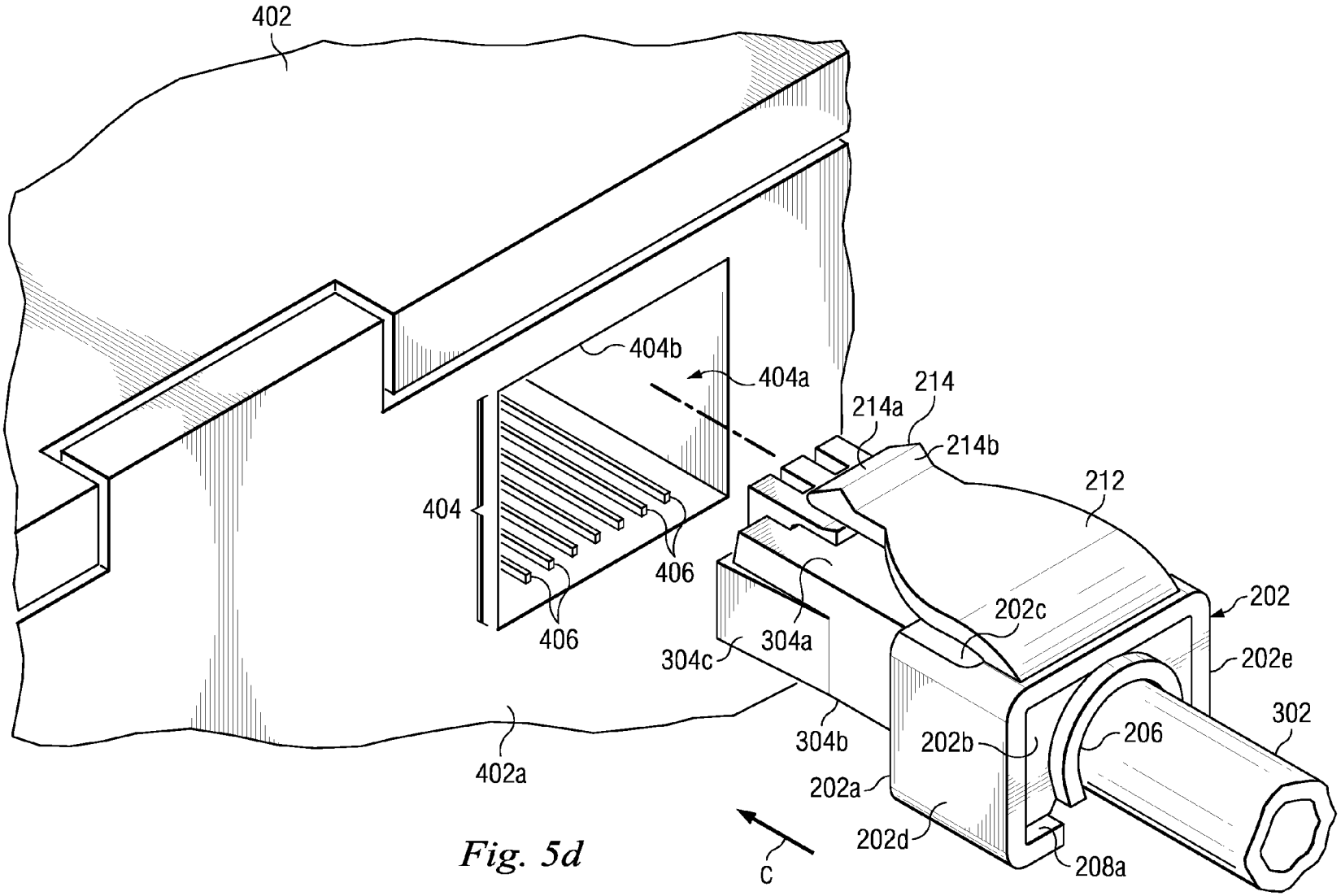
FIG. 5*d* is a perspective view illustrating an embodiment of the cable coupling apparatus and the cable of FIG. 5*b* being coupled to the IHS of FIGS. 4*a* and 4*b*.
Figure 5E:
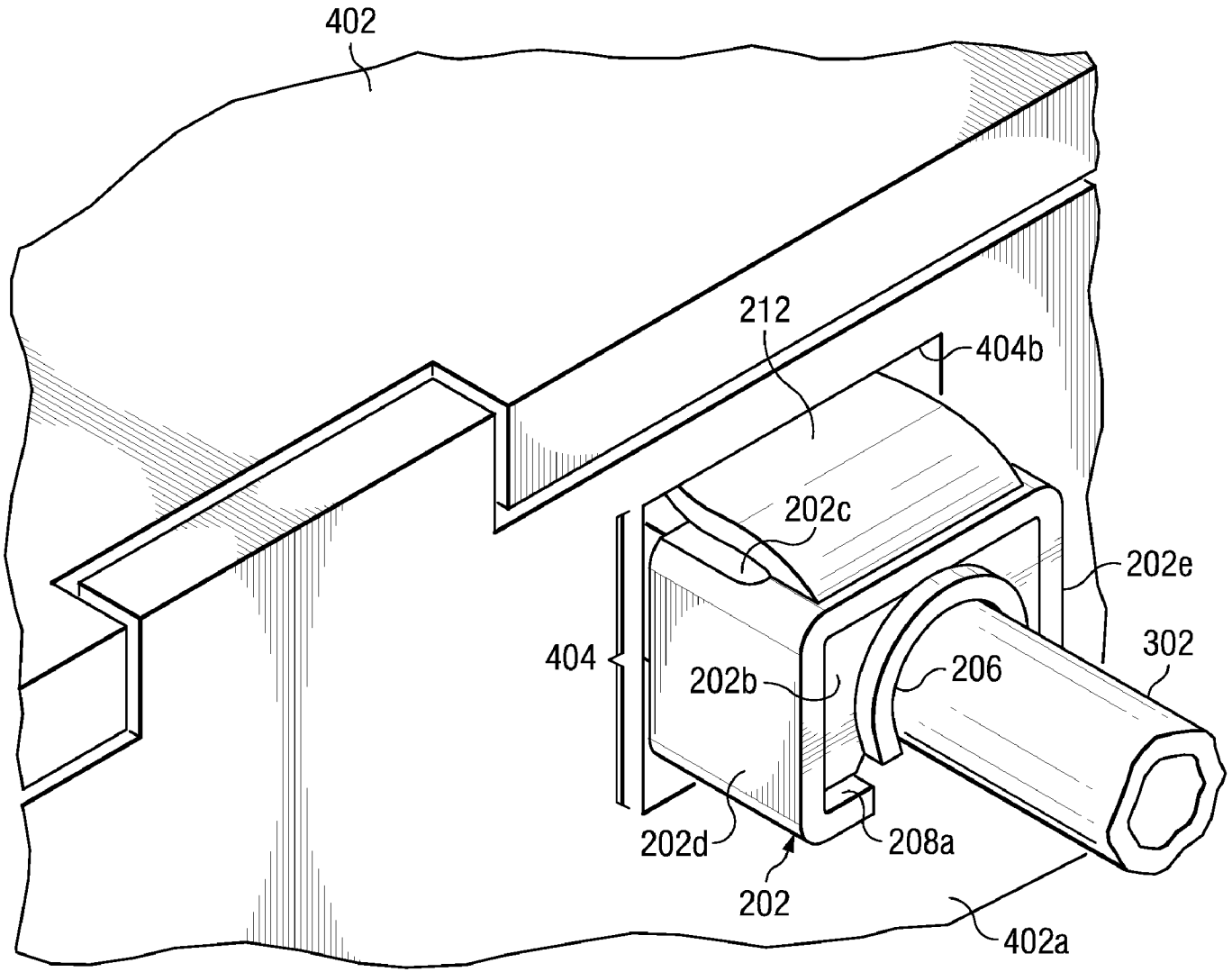
FIG. 5*e* is a perspective view illustrating an embodiment of the cable coupling apparatus and the cable of FIG. 5*b* coupled to the IHS of FIGS. 4*a* and 4*b*.
Figure 5F:
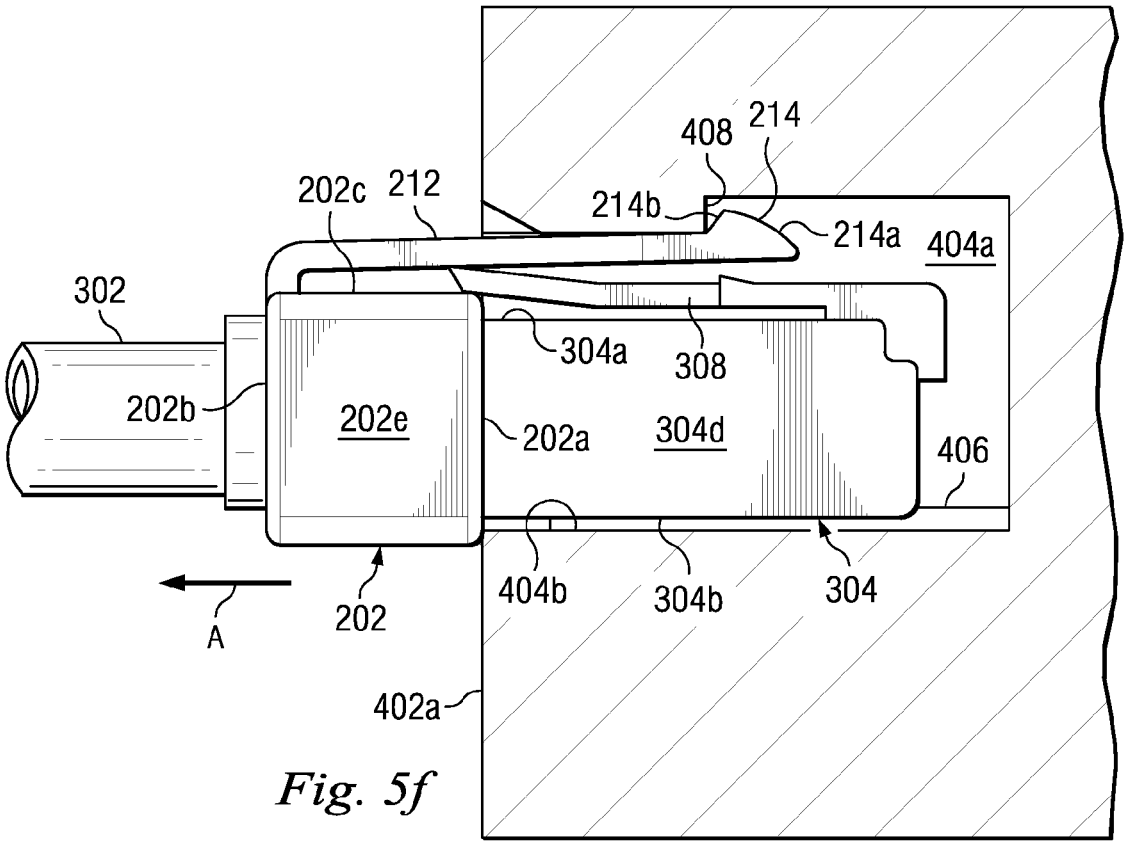
FIG. 5*f* is a partial cross sectional view illustrating an embodiment of the cable coupling apparatus and the cable of FIG. 5*b* coupled to the IHS of FIGS. 4*a* and 4*b*.

Referring now to FIGS. 2*a*, 2*b*, 3, 4*a*, 4*b*, 5*a*, 5*b*, 5*c*, 5*d*, 5*e* and 5*f*, the method 500 then proceeds to step 504 where the connector 304 is engaged with a socket such that the securing member 214 engages a socket surface. The cable 300 with the cable coupling apparatus 200 is positioned adjacent the socket 404 on the IHS chassis 400 such that the bottom surface 304*b* of the connector 304 is located adjacent the plurality of electrical couplers 406 that are located on the socket 404 and adjacent the connector housing 404*a*, as illustrated in FIG. 5*d*. The connector 304 is then moved in an connector attachment direction C, which is substantially opposite to the connector removal direction A, described above with reference to the cable coupling apparatus 200 in FIGS. 2*a*, 2*b*, 5*b* and 5*c*. Movement of the connector 304 in the connector attachment direction C results in the beveled socket coupling member attachment surface 214*a* on the securing member 214 engaging the socket entrance 404*b* such that the socket coupling member 212 is deflected towards the top surface 304*a* of the connector 304. Deflection of the socket coupling member 212 towards the top surface 304*a* of the connector 304 allows the connector 304 to enter the connector housing 404*a* defined by the socket 404, and continued movement of the connector 304 in the connector attachment direction C results in the securing member 214 moving past the socket surface 408 such that the socket coupling member 212 may resiliently bias away from the top surface 304*a* of the connector 304 and allow the socket coupling member release surface 214*b* to engage the socket surface 408, securing the connector 304 in the connector housing 404*a* and to the socket 404, as illustrated in FIGS. 5*e* and 5*f*. With the connector 304 secured in the connector housing 404*a* and to the socket 404 due to the engagement of the socket coupling member release surface 214*b* and the socket surface 408, the plurality of electrical connectors 406 engage a plurality of electrical couplers (not shown) located on the bottom surface 304*b* of the connector 304.

Figure 5G:
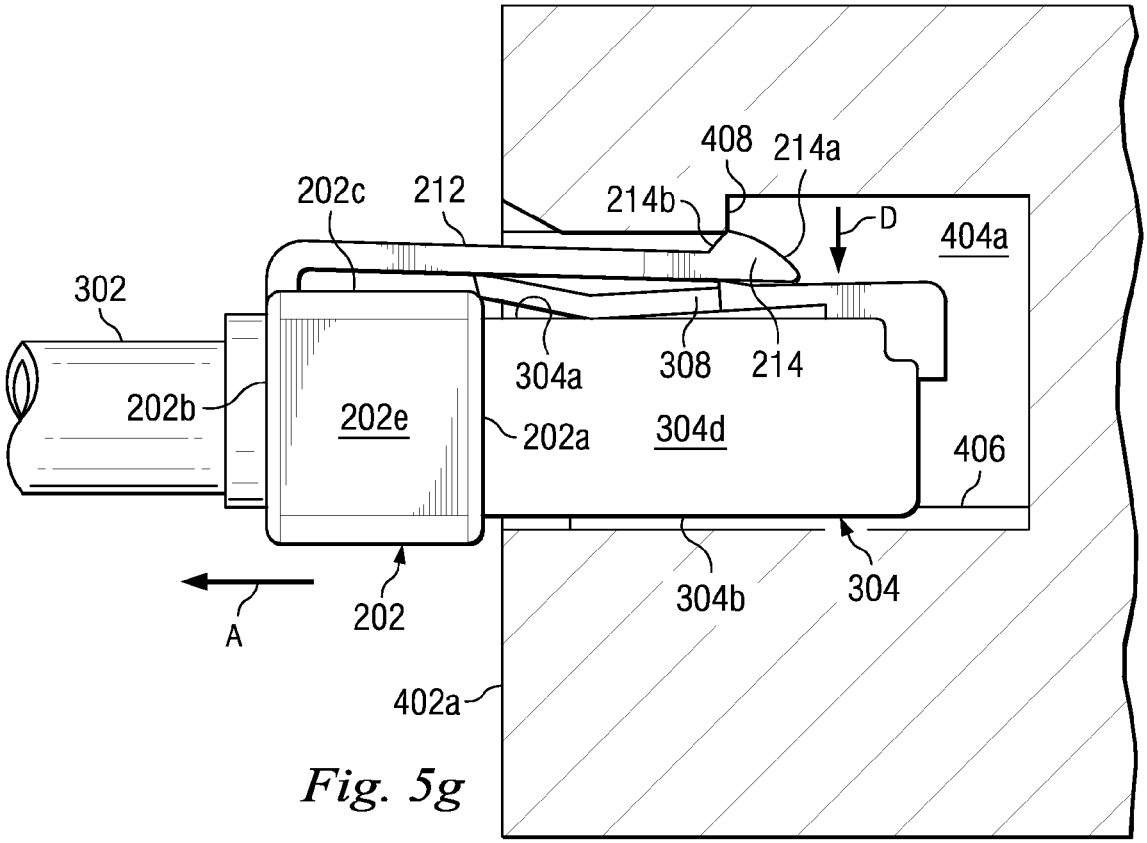
FIG. 5*g* is a partial cross sectional view illustrating an embodiment of the cable coupling apparatus and the cable of FIG. 5*b* being decoupled to the IHS of FIGS. 4*a* and 4*b*.

Referring now to FIGS. 5*a*, 5*f* and 5*g*, the method 500 proceeds to step 506 where the connector 304 is moved in a removal direction such that the securing member 214 engages the socket surface 408 and deflects the socket coupling member 212. The connector 304 is moved in the connector removal direction A and, as a result of the engagement of the socket coupling member release surface 214*b* and the socket surface 408, the socket coupling member 212 moves in a direction D until the securing member 214 no longer engages the socket surface 408 and the continued movement of the connector 304 in the connector removal direction A removes the connector 304 from the connector housing 404*a* defined by the socket 404. In the illustrated embodiment, the socket coupling member release surface 214*b* is oriented at approximately a 45 degree angle relative to the socket surface 408. However, the orientation of the socket coupling member release surface 214*b* relative to the socket surface 408 may be anywhere from greater than 0 degrees and less than 90 degrees depending on the amount of force that is desired to allow the movement of the connector 304 in the connector removal direction A to deflect the socket coupling member 212 such that the connector 304 may be removed from the connector housing 404*a* defined by the socket 404. Thus, a method and apparatus are provided that allow a connector to be coupled to the socket and then removed automatically by moving the connector in a removal direction.

Figure 6:
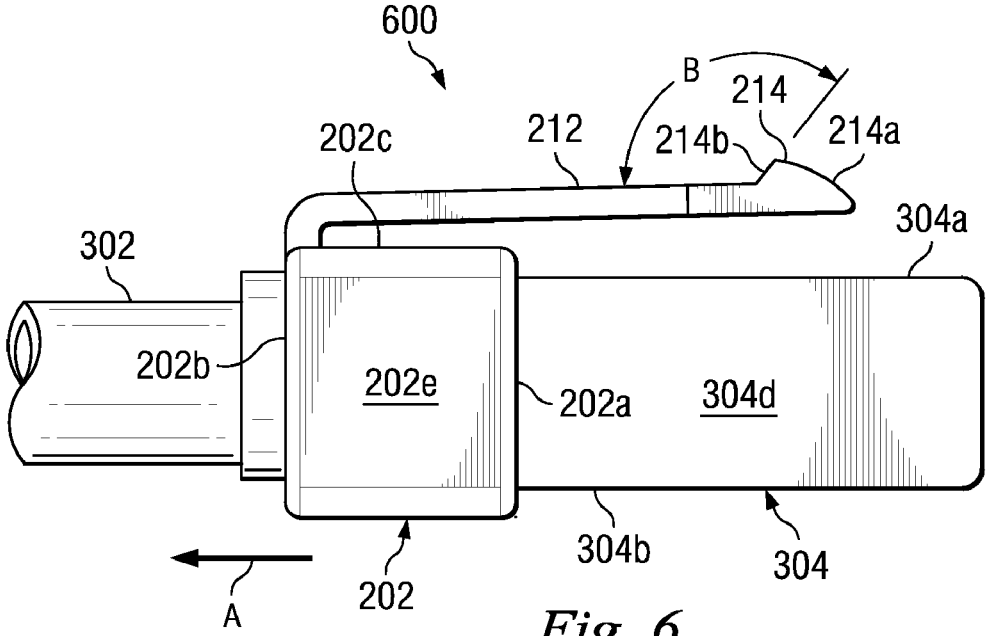
FIG. 6 is a side view illustrating an alternative embodiment of a cable coupling apparatus.

Referring now to FIG. 6, in an alternative embodiment, a cable coupling apparatus 600 is substantially similar in design and operation to the cable coupling apparatus 200 and cable 300, described above with reference to FIGS. 2*a*, 2*b*, 3, 4*a*, 4*b*, 5*a*, 5*b*, 5*c*, 5*d*, 5*e*, 5*f* and 5*g*, with the removal of the connector manual release member 308. The connector manual release member 308 on the cable 300 illustrated how the cable coupling apparatus 200 may be fit onto a conventional cable with a conventional cable coupling apparatus. However, the cable coupling apparatus 600 illustrates how an embodiment may include a socket coupling member 212 including a securing member 214 fabricated as part of the connector 304 coupled to the elongated base cable 302.

Figure 7A:
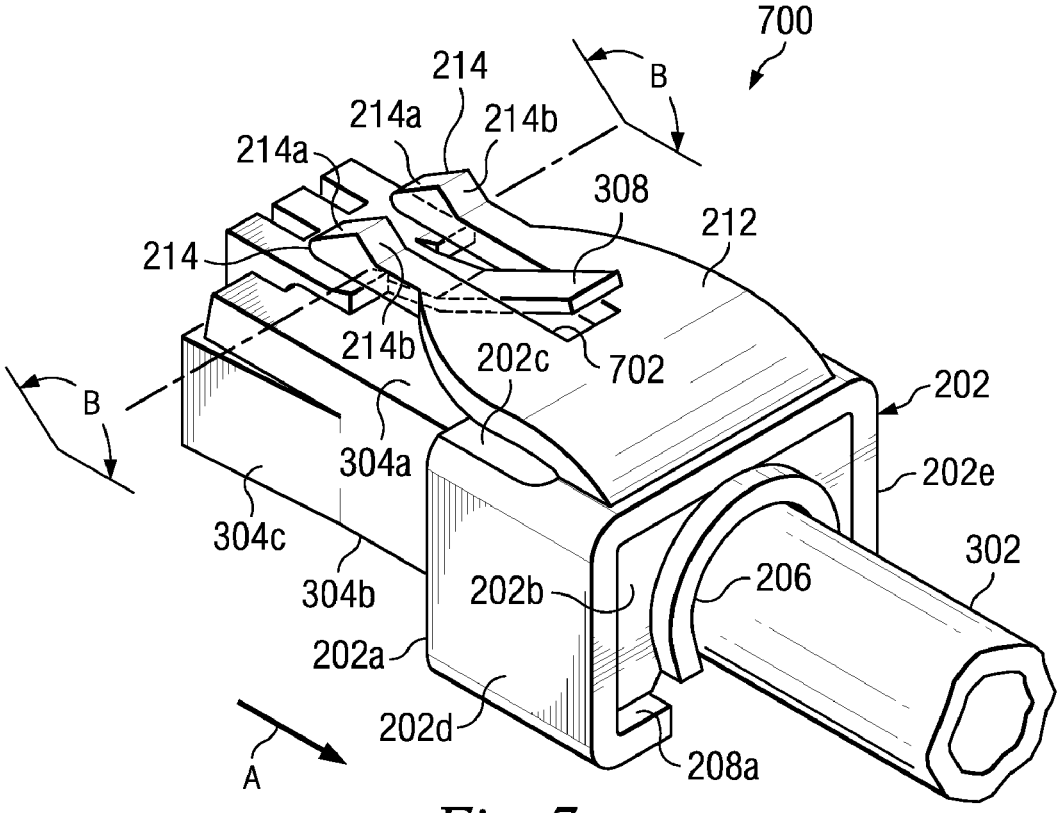
FIG. 7*a* is a perspective view illustrating an alternative embodiment of a cable coupling apparatus.
Figure 7B:
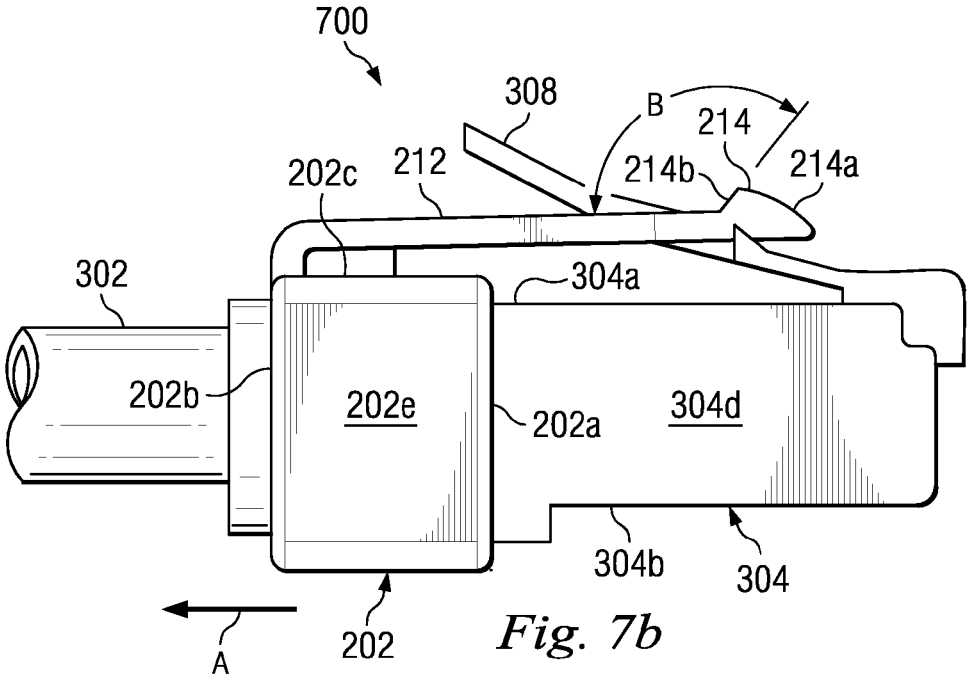
FIG. 7*b* is a side view illustrating an embodiment of the cable coupling apparatus of FIG. 7*a*.

Referring now to FIGS. 7*a* and 7*b*, in an alternative embodiment, a cable coupling apparatus 700 is substantially similar in design and operation to the cable coupling apparatus 200 and cable 300, described above with reference to FIGS. 2*a*, 2*b*, 3, 4*a*, 4*b*, 5*a*, 5*b*, 5*c*, 5*d*, 5*e*, 5*f* and 5*g*, with the provision of a manual release member channel 702 defined by the socket coupling member 212 and substantially centrally located along the length of the socket coupling member 212. The connector manual release member 308 extending from the connector 304 extends through the manual release member channel 702 such that it may be accessed through the socket coupling member 212. In an embodiment, the connector manual release member 308 may be coupled to the socket coupling member 212 in order to allow movement of the socket coupling member 212 towards the top surface 304*a* of the connector 304 by engaging the connector manual release member 308.

Figure 8A:
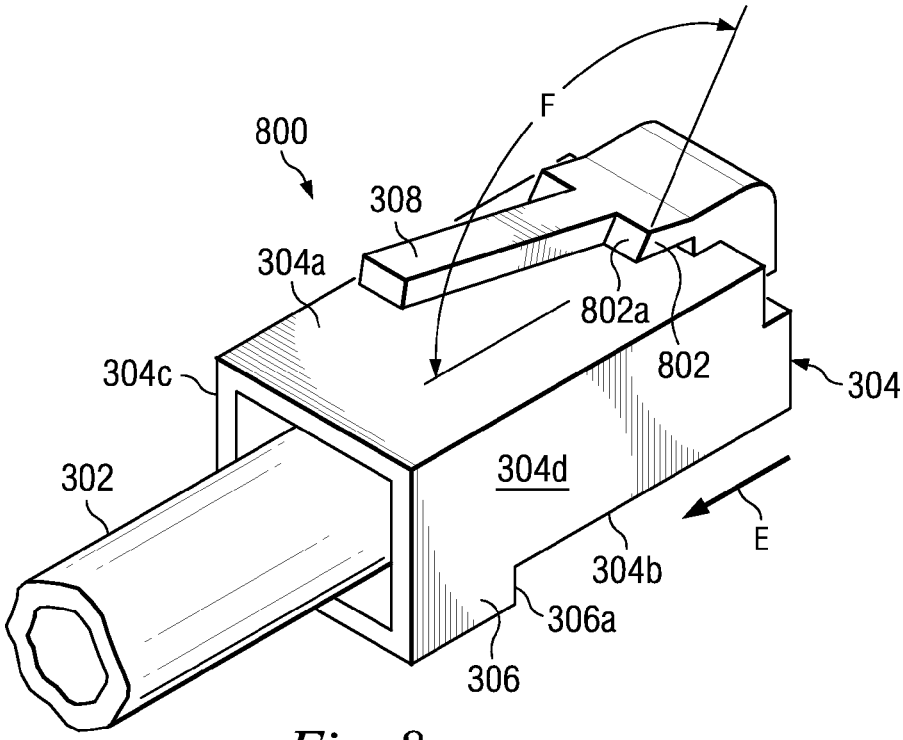
FIG. 8*a* is a perspective view illustrating an embodiment of a cable coupling apparatus.
Figure 8B:
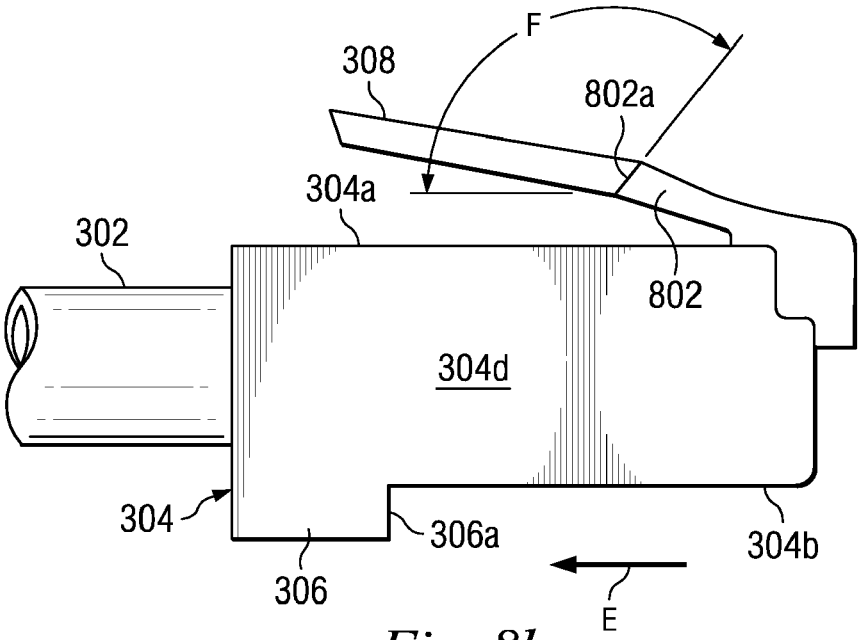
FIG. 8*b* is a side view illustrating an embodiment of the cable coupling apparatus of FIG. 8*a*.

Referring now to FIGS. 8*a* and 8*b*, in an alternative embodiment, a cable coupling apparatus 800 is substantially similar in design and operation to the cable 300, described above with reference to FIG. 3, with the provision of a socket coupling member securing member 802 located on the connector manual release member 308. The cable coupling apparatus 800 includes a connector removal direction E which is substantially parallel to the top surface 304*a*, the bottom surface 304*b*, and the side surfaces 304*c* and 304*d*, and will be explained in further detail below. A socket coupling member release surface 802*a* is located on the socket coupling member securing member 802 and is oriented relative to the connector removal direction E at an angle F that is greater than 90 degrees and less than 180 degrees. In an embodiment, the angle F is approximately 135 degrees.

Figure 9A:
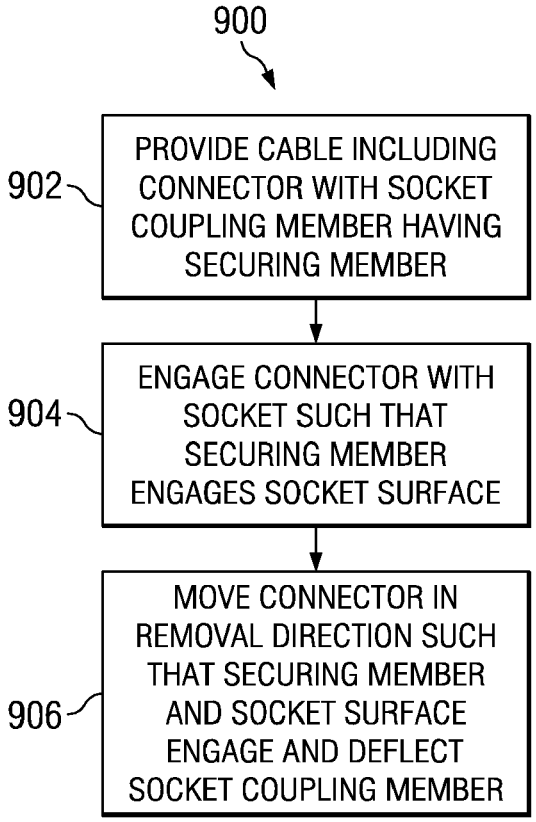
FIG. 9*a* is a flow chart illustrating an embodiment of a method for coupling a cable to an IHS.
Figure 9B:
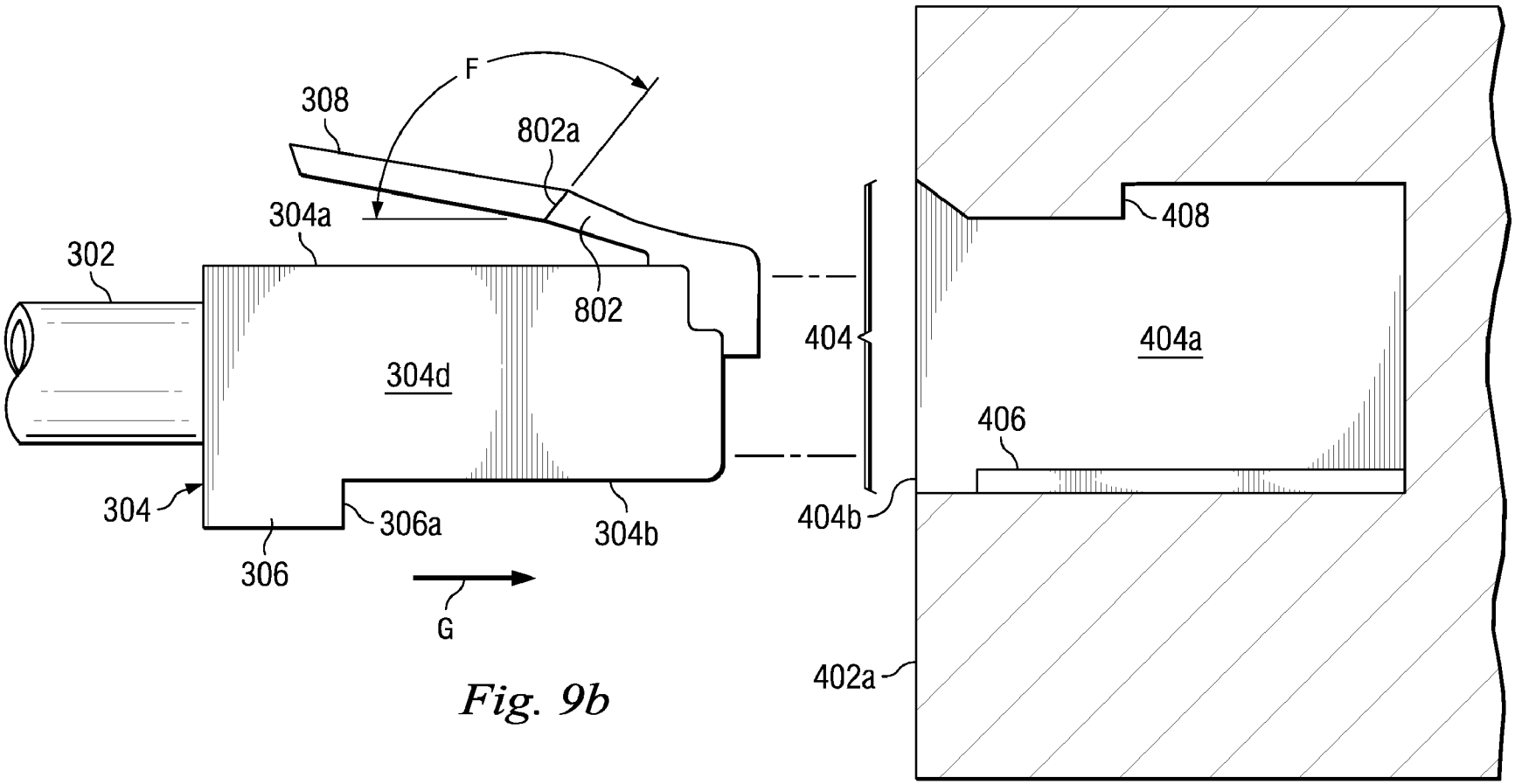
FIG. 9*b* is a partial cross sectional view illustrating an embodiment of the cable coupling apparatus of FIGS. 8*a* and 8*b* being coupled to the IHS of FIGS. 4*a* and 4*b*.
Figure 9C:
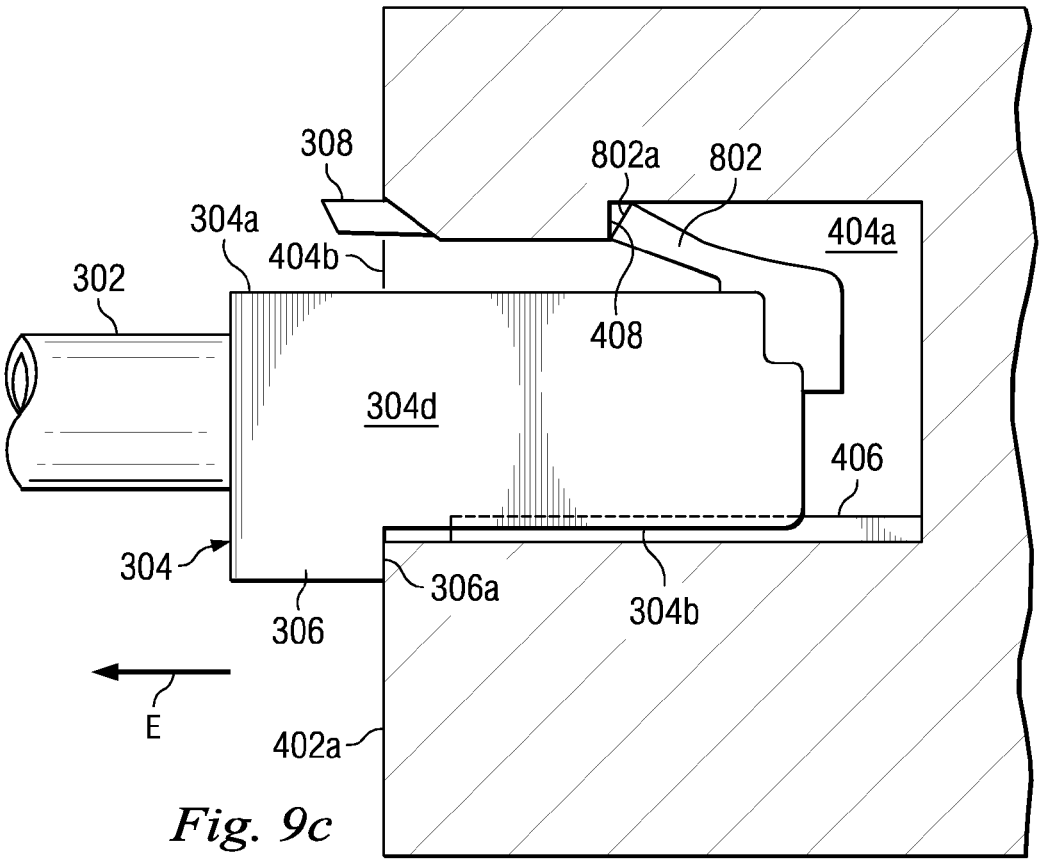
FIG. 9*c* is a partial cross sectional view illustrating an embodiment of the cable coupling apparatus of FIGS. 8*a* and 8*b* coupled to the IHS of FIGS. 4*a* and 4*b*.

Referring now to FIGS. 4*a*, 4*b*, 8*a*, 8*b*, 9*a*, 9*b* and 9*c*, a method 900 for coupling a cable to a socket is illustrated. The method 900 begins at step 902 where a cable including a connector with a socket coupling member having a securing member is provided. The cable coupling apparatus 800, illustrated in FIGS. 8*a* and 8*b*, is provided. The method 900 then proceeds to step 804 where the connector 304 is engaged with a socket such that the socket coupling member securing member 802 engages a socket surface. The cable 800 is positioned adjacent the socket 404 on the IHS chassis 400 such that the bottom surface 304*b* of the connector 304 is located adjacent the plurality of electrical couplers 406 that are located on the socket 404 and adjacent the connector housing 404*a*, as illustrated in FIG. 9*b*. The connector 304 is then moved in a connector attachment direction G, which is substantially opposite to the connector removal direction E, described above with reference to the cable coupling apparatus 800 in FIGS. 8*a* and 8*b*. Movement of the connector 304 in the connector attachment direction G results in the connector manual release member 308 engaging the socket entrance 404*b* such that the connector manual release member 308 and the socket coupling member securing member 802 are deflected towards the top surface 304*a* of the connector 304. Deflection of the connector manual release member 308 and the socket coupling member securing member 802 towards the top surface 304*a* of the connector 304 allows the connector 304 to enter the connector housing 404*a* defined by the socket 404, and continued movement of the connector 304 in the connector attachment direction G results in the socket coupling member securing member 802 moving past the socket surface 408 such that the connector manual release member 308 and the socket coupling member securing member 802 may resiliently bias away from the top surface 304*a* of the connector 304 and allow the socket coupling member release surface 802*a* to engage the socket surface 408, securing the connector 304 in the connector housing 404*a* and to the socket 404, as illustrated in FIG. 9*c*. With the connector 304 secured in the connector housing 404*a* and to the socket 404 due to the engagement of the socket coupling member release surface 802*a* and the socket surface 408, the plurality of electrical connectors 406 engage a plurality of electrical couplers (not shown) located on the bottom surface 304*b* of the connector 304.

Figure 9D:
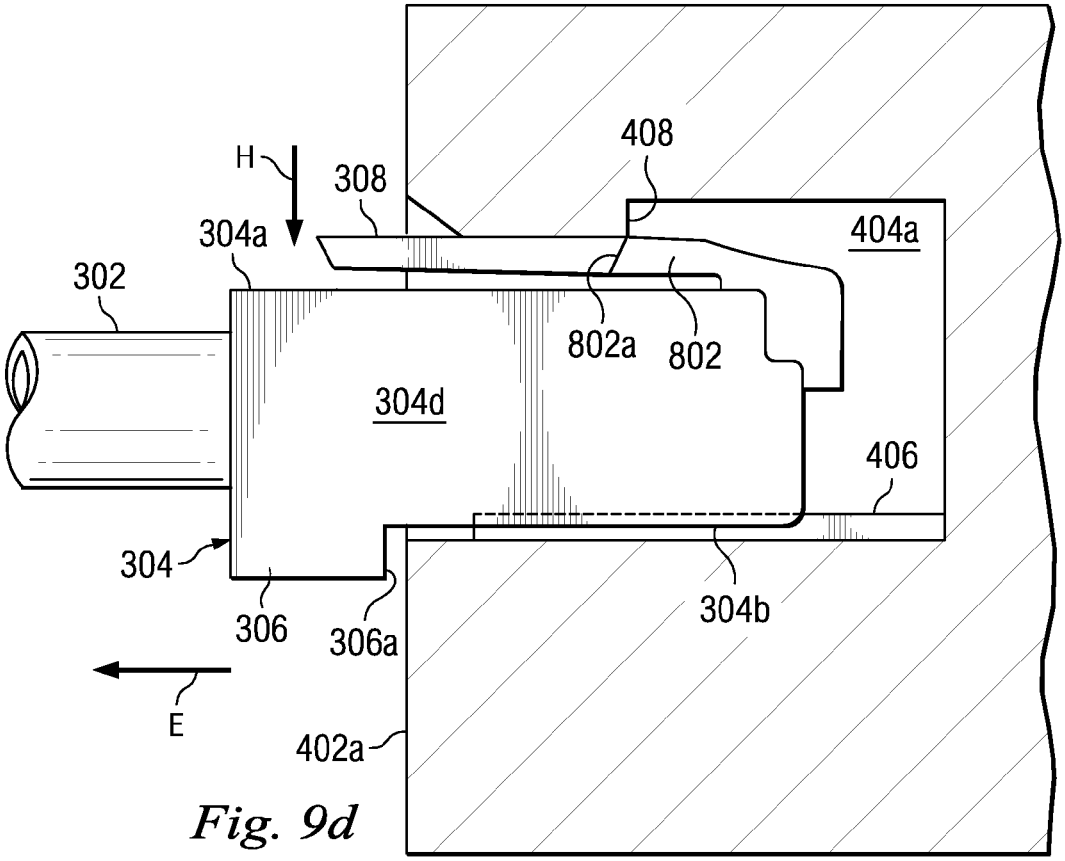
FIG. 9*d* is a partial cross sectional view illustrating an embodiment of the cable coupling apparatus of FIGS. 8*a* and 8*b* being decoupled to the IHS of FIGS. 4*a* and 4*b*.

Referring now to FIGS. 9*a*, 9*c* and 9*d*, the method 900 proceeds to step 906 where the connector 304 is moved in a removal direction such that the socket coupling member securing member 802 engages the socket surface 408 and deflects the connector manual release member 308 and the socket coupling member securing member 802. The connector 304 is moved in the connector removal direction E and, as a result of the engagement of the socket coupling member release surface 214*b* and the socket surface 408, the socket coupling member 212 moves in a direction H until the socket coupling member securing member 802 no longer engages the socket surface 408 and the continued movement of the connector 304 in the connector removal direction E removes the connector 304 from the connector housing 404*a* defined by the socket 404. In the illustrated embodiment, the socket coupling member release surface 802*a* is oriented at approximately a 45 degree angle relative to the socket surface 408. However, the orientation of the socket coupling member release surface 802*a* relative to the socket surface 408 may be anywhere from greater than 0 degrees and less than 90 degrees depending on the amount of force that is desired to allow the movement of the connector 304 in the connector removal direction E to deflect the socket coupling member securing member 802 such that the connector 304 may be removed from the connector housing 404*a* defined by the socket 404. Thus, a method and apparatus are provided that allow a connector to be coupled to the socket and then removed automatically by moving the connector in a removal direction.

Figure 10:
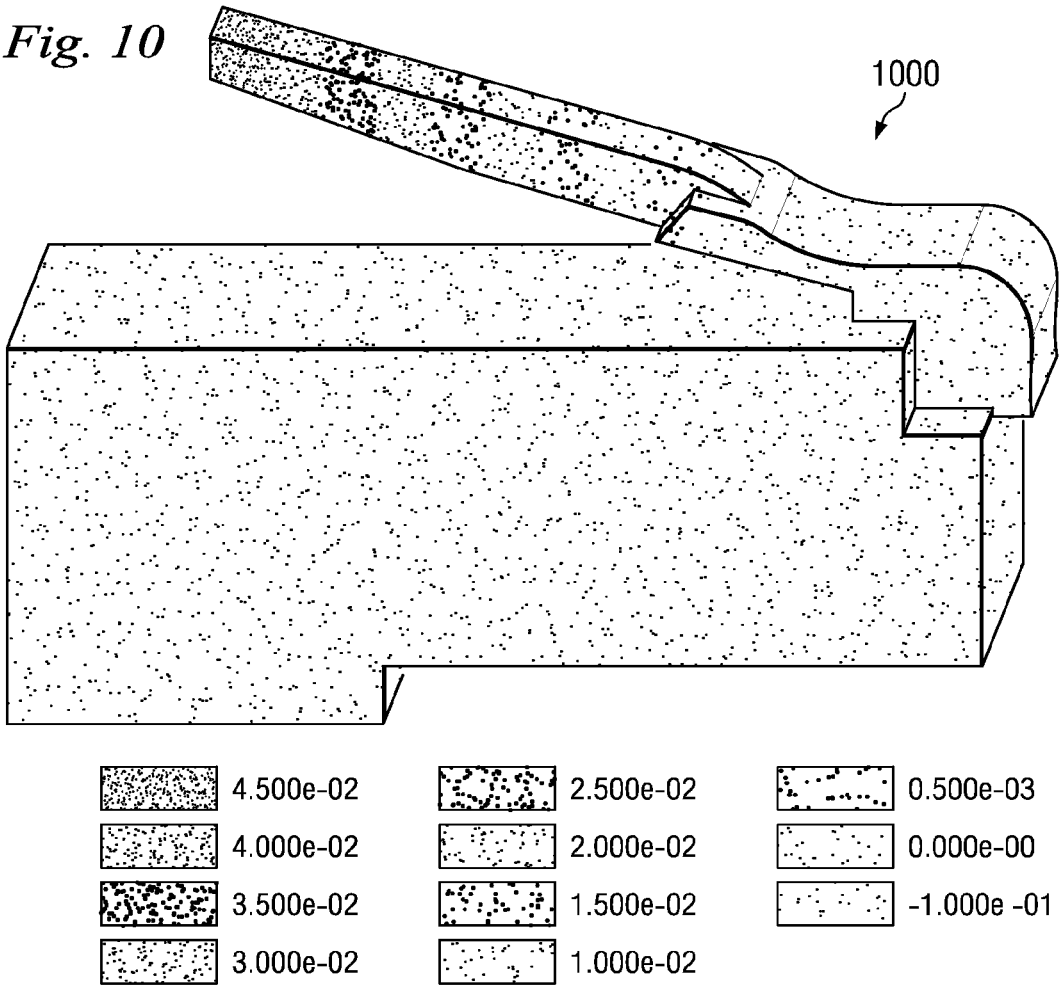
FIG. 10 is a perspective graphical view illustrating an experimental embodiment of the cable coupling apparatus of FIGS. 8*a* and 8*b* showing the deflection of the connector manual release member upon application of 4 pounds of force.

Referring now to FIGS. 8*a* and 10, in an experimental embodiment 1000, the cable coupling apparatus 800 included a socket coupling member release surface 802*a* on the socket coupling member securing member 802 that was oriented relative to the connector removal direction E at an angle of 135 degrees. A force of 4 pounds was applied to the socket coupling member release surface 802*a* and the deflection of the connector manual release member 308 was measured. The embodiment 1000 showed that the connector manual release member 308 and the socket coupling member securing member 802 would deflect enough to remove the connector 304 from a socket, including a maximum deflection of 0.043965 inches at the distal end of the connector manual release member 308.

Figure 11:
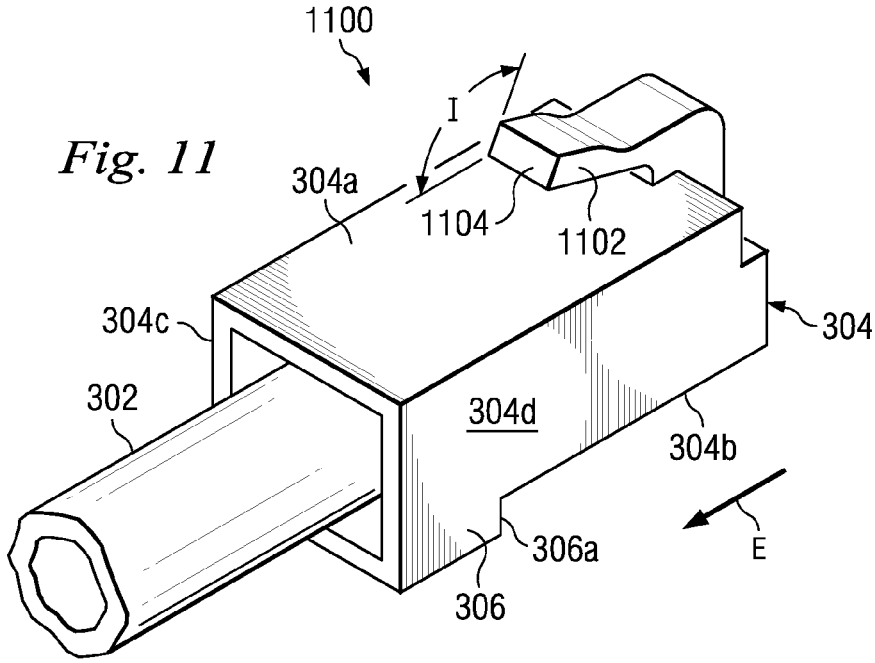
FIG. 11 is a perspective view illustrating an alternative embodiment of a cable coupling apparatus.

Referring now to FIG. 11, in an alternative embodiment, a cable coupling apparatus 1100 is substantially similar in design and operation to the cable coupling apparatus 800, described above with reference to FIGS. 4*a*, 4*b*, 8*a*, 8*b*, 9*a*, 9*b*, 9*c* and 9*d*, with the provision of a socket coupling member securing member 1102 replacing the connector manual release member 308 and the socket coupling member securing member 802. A socket coupling member release surface 1104 is located on the socket coupling member securing member 1102 and is oriented relative to the connector removal direction E at an angle I that is greater than 90 degrees and less than 180 degrees. In an embodiment, the angle I is approximately 135 degrees. The cable coupling apparatus 1100 illustrates that a manual release is not necessary as the connector 304 may be removed from a socket merely by moving the connector 304 in the connector removal direction E.

Figure 12:
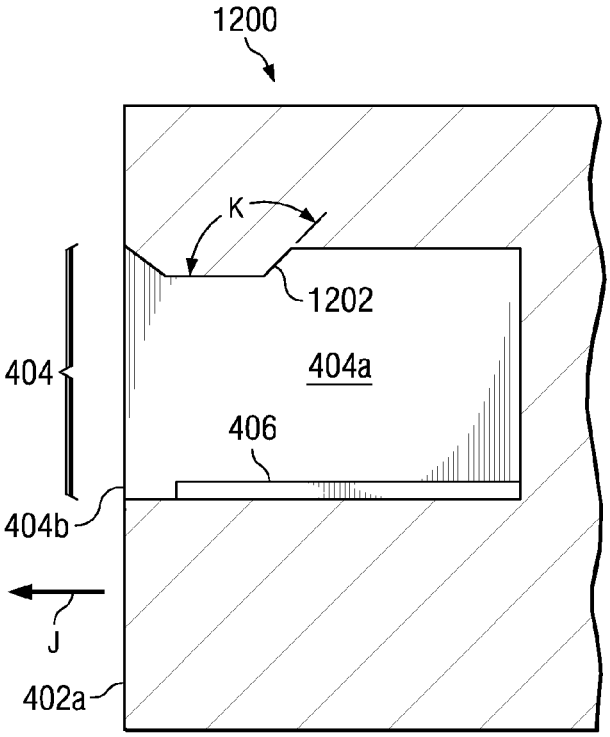
FIG. 12 is a cross sectional view illustrating an alternative embodiment of an IHS.

Referring now to FIG. 12, in an alternative embodiment, an IHS 1200 is substantially similar in design and operation to the IHS 400, described above with reference to FIGS. 4*a* and 4*b*, with the provision of a socket surface 1202 replacing socket surface 408. The IHS 1200 includes a connector removal direction J that is oriented substantially perpendicular to the socket entrance 404*b*, and the socket surface 408 is oriented relative to the connector removal direction J at an angle K that is greater than 90 degrees and less than 180 degrees. In an embodiment, the angle K is approximately 135 degrees.

Figure 13:
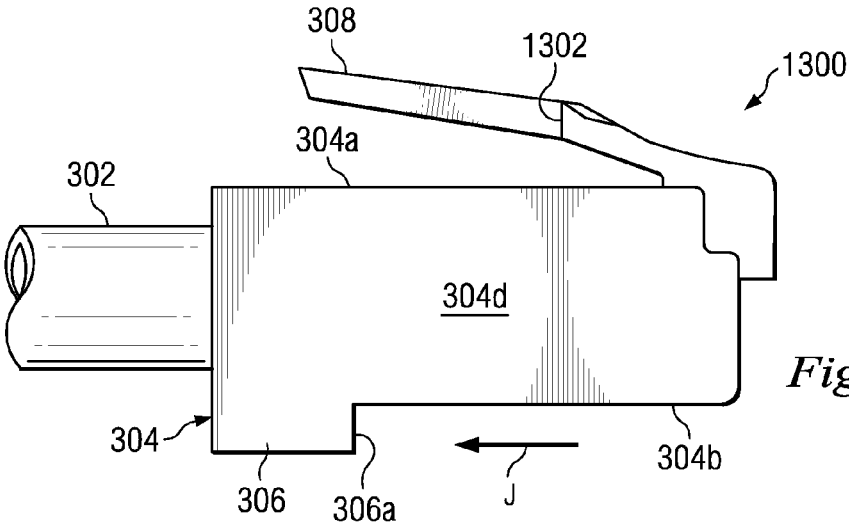
FIG. 13 is a side view illustrating an embodiment of a cable coupling apparatus.

Referring now to FIG. 13, in an alternative embodiment, a cable coupling apparatus 1300 is substantially similar in design and operation to the cable coupling apparatus 800, described above with reference to FIGS. 8*a* and 8*b*, with the provision of a socket coupling member securing member 1302 replacing the a socket coupling member securing member 802. In an embodiment, the socket coupling member securing member 1302 is oriented substantially perpendicularly to the connector removal direction J, described above with reference to the IHS 1200 of FIG. 12.

Figure 14A:
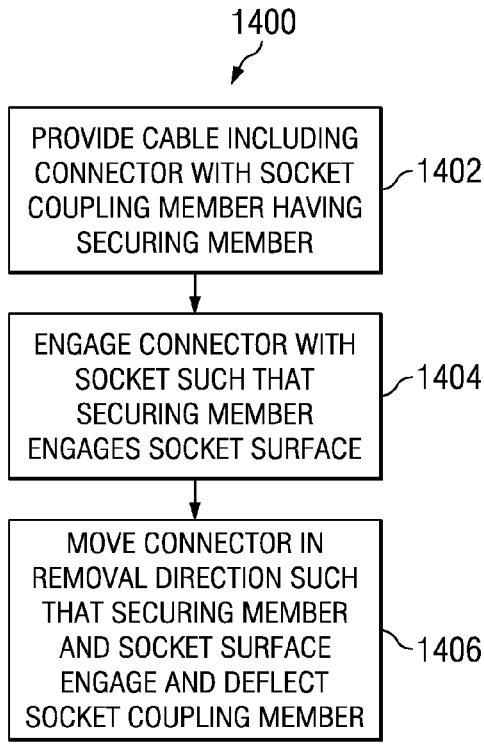
FIG. 14*a* is a flow chart illustrating an embodiment of a method for coupling a cable to an IHS.
Figure 14B:
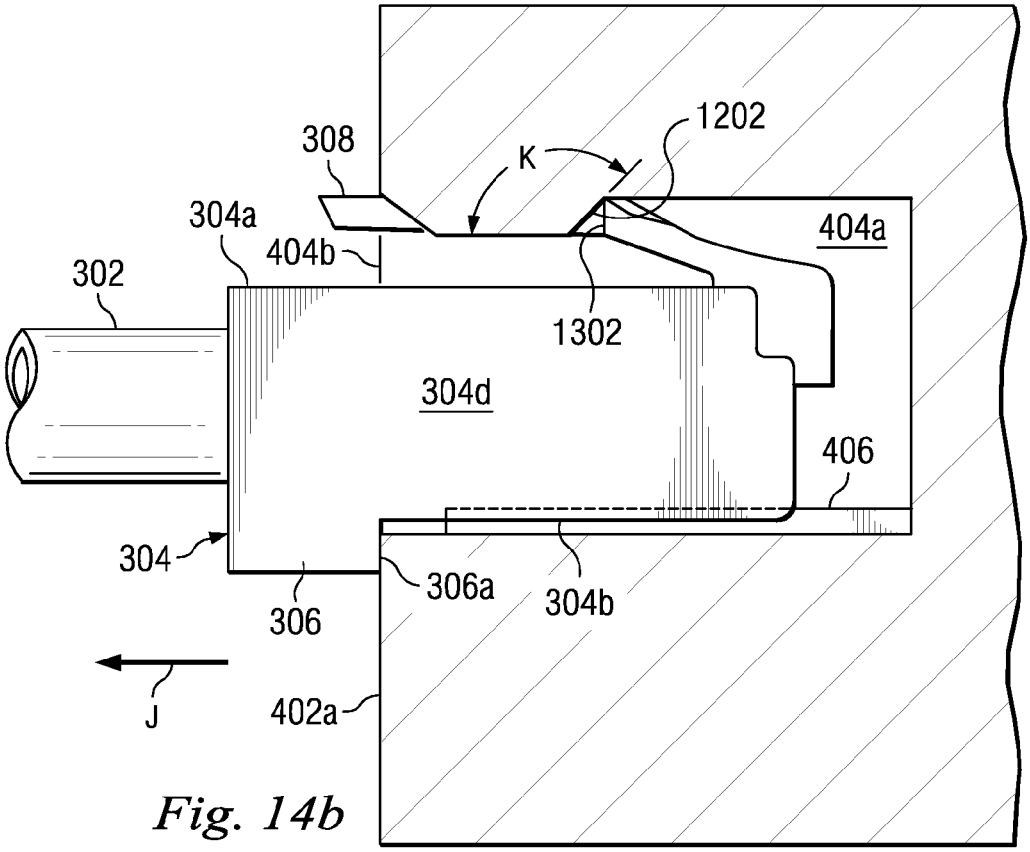
FIG. 14*b* is a partial cross sectional view illustrating an embodiment of the cable coupling apparatus of FIG. 13 being coupled to the IHS of FIG. 12.
Figure 14C:
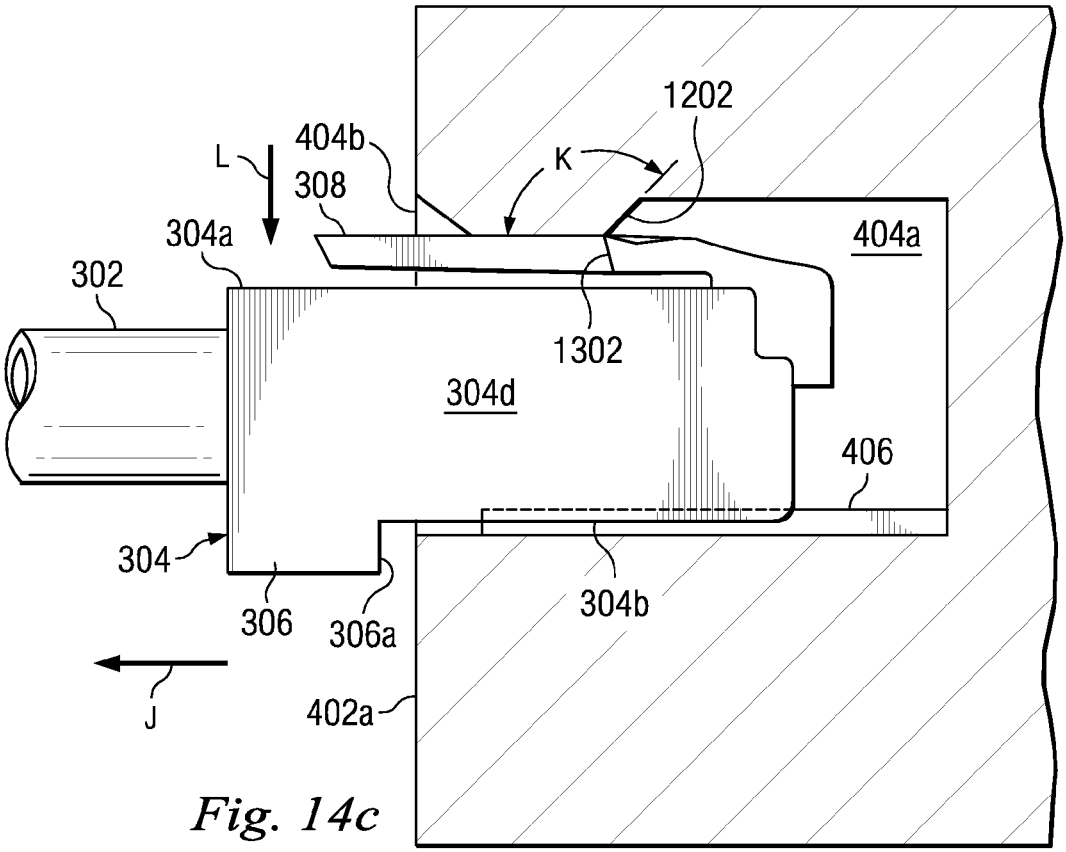
FIG. 14*c* is a partial cross sectional view illustrating an embodiment of the cable coupling apparatus of FIG. 13 being decoupled to the IHS of FIG. 12.

Referring now to FIGS. 14*a*, 14*b* and 14*c*, a method 1400 for coupling a cable to a socket is illustrated. The method 1400 begins at step 1402 where a cable including a connector with a socket coupling member having a securing member is provided. The cable coupling apparatus 1300, illustrated in FIG. 12, is provided. The method 1400 then proceeds to step 1404 where the connector 304 is engaged with a socket such that the socket coupling member securing member 1302 engages a socket surface. The cable coupling apparatus 1300 is positioned adjacent the socket 404 on the IHS chassis 1200 such that the bottom surface 304*b* of the connector 304 is located adjacent the plurality of electrical couplers 406 that are located on the socket 404 and adjacent the connector housing 404*a*. The connector 304 is then moved in an attachment direction, which is substantially opposite to the removal direction J, described above with reference to the cable coupling apparatus 1300 in FIG. 13. Movement of the connector 304 in the attachment direction results in the connector manual release member 308 engaging the socket entrance 404*b* such that the connector manual release member 308 and the socket coupling member securing member 1302 are deflected towards the top surface 304*a* of the connector 304. Deflection of the connector manual release member 308 and the socket coupling member securing member 1302 towards the top surface 304*a* of the connector 304 allows the connector 304 to enter the connector housing 404*a* defined by the socket 404, and continued movement of the connector 304 in the attachment direction results in the socket coupling member securing member 1302 moving past the socket surface 408 such that the connector manual release member 308 and the socket coupling member securing member 1302 may resiliently bias away from the top surface 304*a* of the connector 304 and allow the socket coupling member securing member 1302 to engage the socket surface 1202, securing the connector 304 in the connector housing 404*a* and to the socket 404, as illustrated in FIG. 14*b*. With the connector 304 secured in the connector housing 404*a* and to the socket 404 due to the engagement of the socket coupling member securing member 1302 and the socket surface 1202, the plurality of electrical connectors 406 engage a plurality of electrical couplers (not shown) located on the bottom surface 304*b* of the connector 304.

The method 1400 proceeds to step 1406 where the connector 304 is moved in a removal direction such that the socket coupling member securing member 1302 engages the socket surface 1202 and deflects the connector manual release member 308 and the socket coupling member securing member 1302. The connector 304 is moved in the connector removal direction J and, as a result of the engagement of the socket coupling member securing member 1302 and the socket surface 1202, the socket coupling member securing member 1302 moves in a direction L until the socket coupling member securing member 1302 no longer engages the socket surface 1202 and the continued movement of the connector 304 in the connector removal direction J removes the connector 304 from the connector housing 404*a* defined by the socket 404. In the illustrated embodiment, the socket surface 1202 is oriented at approximately a 135 degree angle relative to the connector removal direction J. However, the orientation of the socket surface 1202 relative to the connector removal direction J may be anywhere from greater than 90 degrees and less than 180 degrees depending on the amount of force that is desired to allow the movement of the connector 304 in the connector removal direction J to deflect the socket coupling member securing member 1302 such that the connector 304 may be removed from the connector housing 404*a* defined by the socket 404. Thus, a method and apparatus are provided that allow a connector to be coupled to the socket and then removed automatically by moving the connector in a removal direction.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. An information handling system (IHS), comprising:

a cable;

a connector coupled to the cable;

a first resilient member being a manual connector release member on the connector;

a cable coupling apparatus coupled to the connector, the cable coupling apparatus comprising:

a base defining a connector channel, wherein the connector is located in the connector channel;

a connector coupling feature located on the base and coupling the connector to the base;

a second resilient member being a socket coupling member resiliently coupled to and extending from the base; and a securing member located on the socket coupling member, wherein the securing member comprises an automatic socket coupling member release surface, the securing member engaging the connector release member and disabling the connector release member with an associated socket; wherein the socket coupling member release surface is beveled such that the socket coupling member may be deflected by the movement of the connector in an attachment and release direction.

2. The system of claim 1, wherein the socket coupling member release surface is oriented relative to the connector removal direction at an angle of approximately 135 degrees such that the socket coupling member may be deflected by the movement of the connector in the connector removal direction and the resulting engagement of a socket surface and the socket coupling member release surface on the securing member in order to remove the connector from a socket.

3. The system of claim 1, wherein the connector comprises a Registered Jack-45 (RJ-45) connector.

4. The system of claim 1, further comprising:

an IHS chassis;

a processor coupled to the IHS chassis; and a socket located on the IHS chassis and electrically coupled to the processor, wherein the socket comprises a socket surface, and wherein the connector is located in the socket and the socket coupling member release surface engages the socket surface.

5. The system of claim 4, wherein the socket surface is oriented substantially perpendicularly to the connector removal direction.

6. The system of claim 5, wherein the socket coupling member release surface is oriented at approximately a 45 degree angle relative to the socket surface.

7. The system of claim 1, wherein the base defines a cable channel located adjacent the connector channel and the cable extends through the cable channel.

8. A method for coupling a cable to a socket, comprising:

providing a cable comprising a connector, the connector including a resilient manua1 release member;

coupling a cable coupling apparatus to the connector, wherein the cable coupling apparatus comprises a socket coupling member resiliently coupled to the cable coupling apparatus and a securing member located on the socket coupling member, the securing member engaging the resilient manual release member and disabling the manual release member;

engaging the cable coupling apparatus with a socket such that the socket coupling member engages the socket and shields the socket from contact with the manual release member; and moving the cable coupling apparatus in a connector attachment and removal direction without manual actuation of the manual release member.

9. The method of claim 8, wherein the coupling comprises moving the cable through an entrance defined by the cable coupling apparatus such that the cable extends through a cable channel defined by the cable coupling apparatus.

10. The method of claim 9, wherein the coupling comprises moving the connector into a connector channel defined by the cable coupling apparatus and then engaging the connector with a connector coupling feature on the cable coupling apparatus.

11. The method of claim 8, wherein the securing member comprises a socket coupling member release surface that is oriented relative to the connector removal direction at an angle of greater than 90 degrees to allow the engagement of the securing member and a socket surface to deflect the socket coupling member out of the securing position in order to allow the connector to be removed from the socket.

12. The method of claim 11, wherein the socket coupling member release surface is beveled such that the socket coupling member may be deflected by the movement of the connector in an attachment and release direction.

* * * * *